US007520343B2

(12) United States Patent
Hughes et al.

(10) Patent No.: US 7,520,343 B2
(45) Date of Patent: Apr. 21, 2009

(54) RETRIEVABLE CENTER BIT

(75) Inventors: John Hughes, Calgary (CA); Tommy M. Warren, Coweta, OK (US)

(73) Assignee: Tesco Corporation, Calgary, AB (CA)

( * ) Notice: Subject to any disclaimer, the term of this patent is extended or adjusted under 35 U.S.C. 154(b) by 0 days.

(21) Appl. No.: 10/906,200

(22) Filed: Feb. 8, 2005

(65) Prior Publication Data

US 2006/0021801 A1 Feb. 2, 2006

Related U.S. Application Data

(60) Provisional application No. 60/521,074, filed on Feb. 17, 2004.

(51) Int. Cl.
*E21B 10/64* (2006.01)

(52) U.S. Cl. ..... 175/257; 175/171; 175/393

(58) Field of Classification Search ..... 175/171, 175/257, 385, 393
See application file for complete search history.

(56) References Cited

U.S. PATENT DOCUMENTS 3,117,636 A * 1/1964 Wilcox, et al. ..... 175/257
3,215,215 A * 11/1965 Kellner ..... 175/405.1
3,554,304 A 1/1971 Link et al.
3,682,260 A * 8/1972 Klemm ..... 175/92
3,880,247 A 4/1975 Harding
4,651,837 A 3/1987 Mayfield
5,186,265 A 2/1993 Henson et al.
5,271,472 A 12/1993 Letumo
5,472,057 A * 12/1995 Winfree ..... 175/57
5,568,838 A 10/1996 Struthers et al.
5,845,722 A * 12/1998 Makohl et al. ..... 175/101
5,954,146 A 9/1999 McLeod et al.
6,006,844 A 12/1999 Van Puymbroeck et al.
6,106,200 A * 8/2000 Mocivnik et al. ..... 405/259.5
6,454,024 B1 9/2002 Nackerud
6,517,902 B2 * 2/2003 Drake et al. ..... 427/249.8
6,857,487 B2 * 2/2005 Galloway et al. ..... 175/171
2003/0141111 A1 7/2003 Pia

OTHER PUBLICATIONS

Development of a Commercial Wireline Retrievable Coring System Warren, Tommy et al. Copyright 1996, Society of Petroleum Engineers, Inc.

* cited by examiner

*Primary Examiner*—Shane Bomar
(74) *Attorney, Agent, or Firm*—Bracewell & Giuliani LLP

(57) ABSTRACT

A retrievable center bit for use with a tubular including an inner bore and a drill shoe cutter mounted thereon. The retrievable center bit may include a body positionable in the bore of the tubular and including an upper end, a lower end and a side outer surface extending therebetween. A cutting surface may be supported on the lower end of the bit body. There may be a locking assembly on the body for releasably locking the bit axially and rotationally to the tubular. A longitudinal bore may extend from the upper end into the body and the body may include a fluid port extending from the bore to open on the cutting surface and a lateral fluid port extending from the bore opening on the side outer surface positionable adjacent the drill shoe cutter when the bit is locked to the tubular.

11 Claims, 1 Drawing Sheet

RETRIEVABLE CENTER BIT

FIELD OF THE INVENTION

The invention relates to a bit for drilling wellbores through earthen formations and, in particular, to a bit for drilling and which is retrievable through a drill string to which it is attached.

BACKGROUND

It is common that wellbores through earthen formations, such as in the petroleum industry, are lined with strings of tubulars. Such a tubular string is termed herein casing but can sometimes be termed a liner, depending on the position of the string in the well. Both when running in casing and when drilling the borehole with casing, which is to remain downhole, it is sometimes useful to connect a bit to the lower end of the string to open up, drill or extend the borehole.

When a bit is used with a string of casing and the casing is intended to remain in position downhole, it is often desirable that the bit be retrievable through the casing string to surface. To permit the bit to be retrieved, the drill bit can have a maximum outer diameter less than the drift diameter through the casing. Such a bit can drill a borehole less than the outer diameter of the casing but requires a means for enlarging the borehole to permit passage of the casing. To enlarge the borehole diameter, sometimes the bit includes or is connected to one or more under reamer arms. In addition or alternately, cutters can be mounted on the lower end of the casing forming a section called a drill shoe. The drill shoe can be used with a pilot bit to make drilling runs.

SUMMARY

A borehole drilling tool has been invented including a retrievable center bit. The bit can be used with casing drill shoe, which term herein is intended to include a liner drill shoe, for drilling a borehole.

In accordance with a broad aspect of the present invention, there is provided a retrievable center bit body for positioning in a tubular including an inner bore and a drill shoe cutter mounted thereon, the retrievable center bit body comprising: an upper end, a lower end formed for supporting a cutting surface, an outer surface extending between the upper end and the lower end, a locking assembly for releasably locking the bit body axially and rotationally to the tubular, a longitudinal bore extending from the upper end toward the lower end, a lateral fluid port extending from the bore and opening on the outer surface positionable adjacent the drill shoe cutter when the bit body is locked to the tubular.

In accordance with a broad aspect of the present invention, there is provided a retrievable center bit for use with a tubular including an inner bore and a drill shoe cutter mounted thereon, the retrievable center bit comprising: a body positionable extending into the bore of the tubular and including an upper end, a lower end and a side outer surface extending therebetween, a cutting surface supported on the lower end, a locking assembly on the body for releasably locking the bit axially and rotationally to the tubular, a longitudinal bore extending from the upper end into the body, a fluid port extending from the bore to open on the cutting surface and a lateral fluid port extending from the bore opening on the side outer surface positionable adjacent the drill shoe cutter when the bit is locked to the tubular.

In accordance with another aspect of the present invention, there is provided a borehole drilling tool including a drill shoe including an upper end formed for connection to a wellbore tubular, a lower end supporting a drill shoe cutter and an inner surface formed to define a locking assembly first part; and a retrievable center bit including an upper end, a lower end and a side outer surface extending therebetween, a cutting surface supported on the lower end, a locking assembly second part on the body for releasably locking the bit axially and rotationally to the locking assembly first part, a longitudinal bore extending from the upper end into the body, a fluid port extending from the bore to open on the cutting surface and a lateral fluid port extending from the bore and opening adjacent the drill shoe cutter when the locking assembly first part and the locking assembly second part are locked together.

DESCRIPTION OF THE INVENTION

Figure 1A:
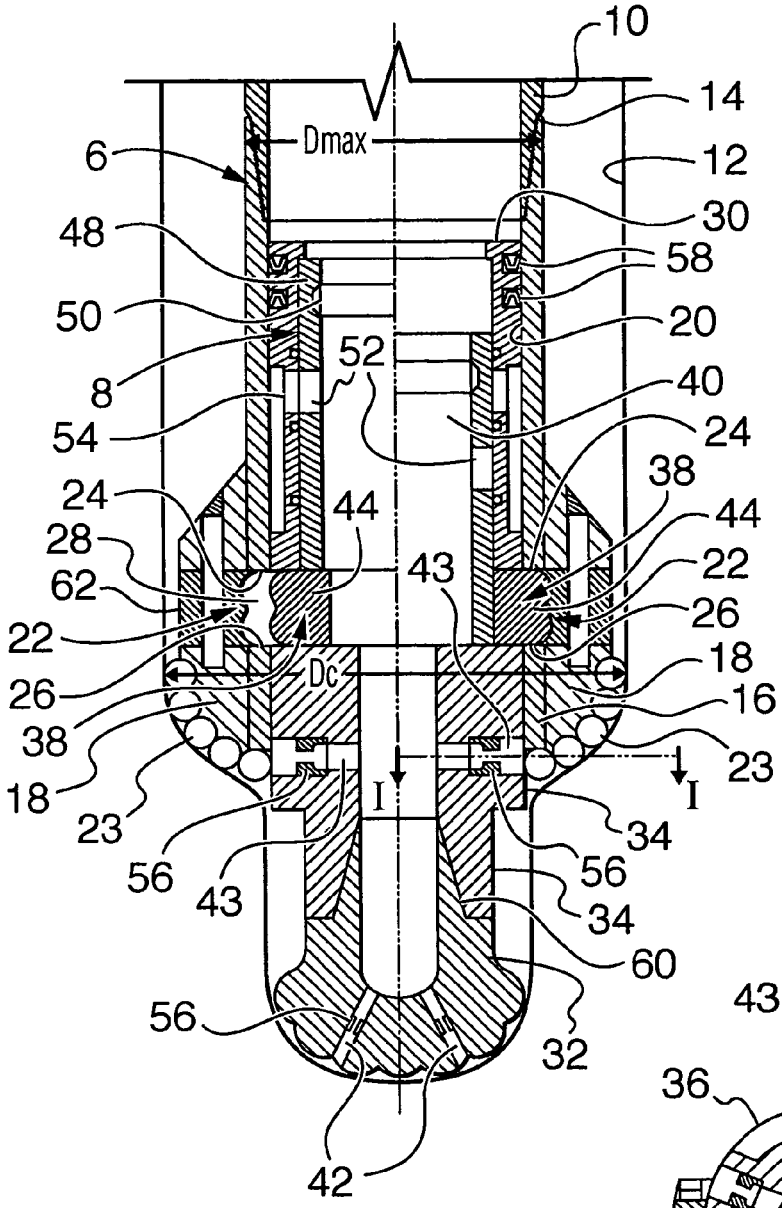
FIG. 1A is a longitudinal sectional view of a borehole drilling tool including a retrievable center bit and a drill shoe in a wellbore. The left side of the section shows the body portion unlocked from the drill shoe and the right side of the section shows the body portion locked into the drill shoe.
Figure 1B:
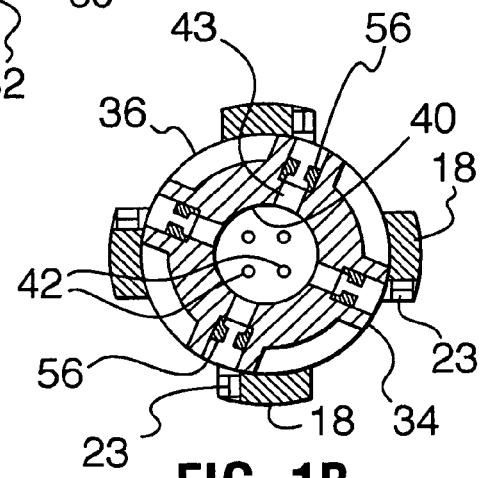
FIG. 1B is a sectional view through a borehole drilling tool. The section is viewed with referecen to line 1-1 of FIG. 1A.

FIGS. 1A and 1B illustrate a borehole drilling tool including a drill shoe 6 and a retrievable center bit 8. The borehole drilling tool can be connected at a lower end of a casing string 10 with retrievable center bit 8 locked into drill shoe 6. The borehole drilling tool can be operated, by rotation thereof with circulation of drilling fluid, to drill a borehole 12. When desirable, bit 8 can be unlocked from the drill shoe and pulled to surface through the drill shoe and casing string, leaving the casing string and drill shoe open for further processes or passage of tools. Alternately, bit 8 can be left downhole and the well bore can be completed with the bit in place.

Drill shoe 6 can include an upper end 14 formed for connection to a wellbore tubular, a lower end 16 supporting one or more drill shoe cutters 18 and an inner surface 20 formed to define a locking assembly first part 22. In the illustrated embodiment, upper end 14 can include a threaded box, to accommodate threaded connection to the end of a wellbore casing string. When connected, the center bore defined by inner surface 20 is open to the bore of the casing string.

Drill shoe cutters 18 can be blades or structures suitable for reaming the wall of borehole 12. To facilitate distribution of forces, cutters 18 can be spaced apart about the circumference of the drill shoe lower end 16. Between each cutter 18 is formed a junk slot for passage of drilling fluid and cuttings. Cutters 18 define an outer diameter Dc greater than the maximum outer diameter Dmax of the casing string being fed into borehole 12 formed by the drilling tool. In one embodiment, the drill shoe cutters can support polycrystalline diamond compact (PDC) inserts 23.

Locking assembly first part 22 includes structures for locking retrievable center bit 8 against axial and rotational movement in the drill shoe. In the illustrated embodiment, the locking structures include a plurality of combination axial and torque lock profiles including upper 24, lower 26 and side 28 edges. Generally, it is not desirable that the locking structures of locking assembly first part 22 reduce the casing drift diameter and generally, therefore, it is desirable that the structures be formed as slots, grooves, keyways, recesses, etc. in the tubular wall.

Retrievable center bit 8 can include a body defined by an upper end 30, a lower end 32 and a side outer surface 34 extending therebetween. Bit 8 can be formed to be retrievable through the bore of casing string 10 and, therefore, can have an outer diameter smaller than the drift diameter of the casing string. A cutting surface 36 can be supported on the lower end, for example, by way of a pilot bit connected at a bit box 60 or by cutters mounted directly on the lower end. Bit 8 can further include a locking assembly second part 38 for releasably locking the bit axially and rotationally to the locking assembly first part 22 of the drill shoe. A longitudinal bore 40 can extend from upper end 30 into the body. Retrievable center bit 8 can include one or more fluid ports 42 extending from bore 40 to open on cutting surface 36 and one or more lateral fluid ports 43 extending from the bore opening on side outer surface 34 adjacent the drill shoe cutters 18 when locking assembly first part 22 and locking assembly second part 38 are locked together.

Cutting surface 36 can be suitable for cutting a borehole through an earthen formation. Cutting surface 36 can, for example, include roller cones, pdc cutters, etc., as desired, for example with consideration as to the drilling conditions.

Locking assembly second part 38 can include a structure to act with the locking assembly first part. In the illustrated embodiment, the locking assembly second part includes a plurality of outwardly biased lock dogs 44 selected to engage into the plurality of combination axial and torque lock profiles in the drill shoe. In addition, the locking assembly can include a releasable lock that permits lock dogs 44 to be locked out into the profiles in drill shoe 6 to engage against edges 24, 26, 28. However, the releasable lock can be unlocked to permit the lock dogs to collapse out of engagement with the profiles, such as when it is desired to pull the bit up hole. In the illustrated embodiment, the releasable lock includes a lock sleeve 48 that is positioned behind the lock dogs 44 to hold the lock dogs extended radially outwardly, but can be moved, as by use of a sleeve shifting tool for which an engagement groove 50 may be provided, away from the lock dogs to permit them to collapse radially inwardly. In another embodiment, a ball actuated lock sleeve may be used. In such an embodiment, lock sleeve may include a seat for a drop ball and a ball can be dropped and pressure applied to shift the sleeve and unlock axial torque lock dogs. A no-go ring may be provided to prevent the applied pressure from pumping the bit out the bottom of drill shoe. After unlocking the bit from the drill shoe, a retrieving tool can be run in to remove the bit from the well.

It is to be noted that the illustrated lock dogs/lock sleeve are intended to be set in the locked position at surface and are not lockable downhole. However, many locking arrangements may permit run in and setting downhole of the bit and such locking arrangements will be readily apparent to those skilled in the art.

Longitudinal bore 40, extending from body upper end 30 to fluid ports 42 and 43, can be open to the bore of casing string 10 when the bit is installed in the casing string for use. Bore 40 and fluid ports 42, 43 can provide for drilling fluid circulation through the bit as borehole 12 is being drilled.

Fluid ports 42 can be positioned to clean and lubricate cutting surface 36 of the bit.

Fluid ports 43 may open on an outer surface, such as side surface 34, and can be in a selected position to clean and lubricate cutters 18 of the drill shoe. Lateral ports 43 can be positioned adjacent each cutter 18 to provide a cleaning and lubricating effect for each cutter. In particular, it is desirable that lateral ports 43 be positioned to direct drilling fluid at the cutting face of the cutters, for example at inserts 23. Ports 43 can be positioned above the lower-most position and on the cutting side of the cutters, with consideration to the direction of drilling rotation of the cutters, or partially beneath the cutters on the sides adjacent their cutting faces. In this position, fluid is jetted from ports 43 into a cut area of the formation, rather than directly against a face of the formation that has not yet been cut, so that the force of the jetting fluid can be applied against the cutters rather than being dissipated against the formation.

Since the lateral ports are on bit 8 and cutters 18 are on the drill shoe, it is desirable to fix the position of the lateral ports with consideration to cutter positioning on the drill shoe to ensure that the lateral ports are operationally positioned after locking the parts together. This may facilitate installation of the bit in the drill shoe. In one embodiment, the lateral ports can be positioned relative to locking assembly second part 38 and locking assembly first part 22 and cutters 18 can be correspondingly positioned to permit appropriate positioning of the lateral ports with the cutters after installation of the bit in the drill shoe.

Ports 42, 43 can be formed to cause fluid to jet therethrough so that the force of fluid passing through the ports can be sufficient to clean away debris adjacent the port. In the illustrated embodiment, ports 42, 43 may each include nozzles 56 installed therein for causing fluid jetting. Nozzles 56 can be formed to be removable, as by use of threaded installation, from the ports for replacement.

Seals 58 can be provided about outer surface 34 of the bit to ensure that drilling fluid passes down through the bit rather than about it. Seals 58 can be of any type, but are illustrated as poly-pac type seals in this embodiment. Seals 58 may also control fluid passage in both directions between the bit and the drill shoe.

Sleeve 48 can also include a port 52 that is alignable, when sleeve is in the unlocked position, with a bypass port 54 through the bit body and about lower end 32 of the bit. Bypass port 54 may facilitate tripping of the retrievable bit through the casing string, as fluid passage through ports 42, 43 may be restricted.

The retrievable center bit can be constructed in various ways. While the bit could be made as a one-piece tool, it is useful to form it of interconnectable subs for ease of construction and repairability. For example, lower end 32 carrying cutting surface 36 can be any pilot bit configuration connected to the remainder of the tool at a bit box connection 60. By installing a replacement lower end 32 with a new cutting surface, the remainder of the bit can be reused and installed into another drill shoe for drilling or opening up a borehole.

Where the body is formed of multiple subs, it may be useful to form Lateral ports 43 on a part integral with locking assembly second part 38 so that radial positioning between these parts can be selected and fixed with consideration of the relative positioning of the locking assembly first part and drill shoe cutters 18.

Portions of the bit, for example upper body 30, can be formed of durable materials, with consideration to downhole conditions. It may be useful to select a material of relatively light weight, such as aluminum, to reduce the tool's weight and yet retain mechanical properties close to those of steel.

The profiles in drill shoe 6 can be formed in various ways. In one embodiment, for example, the profiles can be formed in mounting ends 62 of cutters 18. The profiles can be, therefore, aligned over the cutters to in an attempt to facilitate positioning of ports 43. These cutters can be installed, as by welding, in slots formed on the end of a casing shoe.

The retrievable center bit can be used for drilling holes or other applications. As will be appreciated, drill shoe cutters may not be replaced during a drilling operation. To drill a borehole, a bit 8 including a cutting surface 36 is installed in drill shoe, as by installation at surface or running the bit through the casing string to interengage the locking assembly first and second parts. In so doing, lateral ports 43 are positioned to direct fluid to be jetted therethrough to cutters 18 of the drill shoe.

The drill shoe is then rotated to rotate the bit and its cutting surface. The cutting surface 36 drills a pilot hole and cutters 18 on the drill shoe ream out the pilot hole to form borehole 12. Cutters 18, defining outer diameter Dc which is greater than the maximum outer diameter Dmax of the casing string, ream the borehole to a diameter greater than Dc so that the casing string 10 can pass into the borehole 12. During drilling, fluid is circulated down through the casing bore and out through ports 42 and 43. Drilling fluid jetting through ports 42 acts to clean and lubricate cutting surface 36 and drilling fluid jetting through ports 43 act to clean and lubricate drill shoe cutters 18. Drilling fluid can then pass up the annulus about casing string 10.

In FIG. 1, cutting surface 36 is positioned to act ahead of cutters 18. In another embodiment, the retrievable center bit may be formed such that the cutting surface of the retrievable bit may be at the same or substantially the same plane as the cutters of the drill shoe. This places the two cutting structures such that they cut through the same rock at about the same time and may avoid the situation where one cutting structure takes all the weight when going separately through hard rock streaks.

The cutting surface installed or formed on retrievable bit 8 and cutters 18 can be correspondingly formed to create a uniform cutting structure. For example, the cutting surface 36 may include a number of rows of pdc cutters and drill shoe may be selected to support an equal number of cutters 18 so that the cutters may be substantially aligned with rows of cutters on cutting surface 36. In another embodiment, the cutting structures of the bit's cutting surface and of the drill shoe cutters can be correspondingly arranged to overlap in their cutting action. In particular, the bit and drill shoe may be formed to permit the pilot bit cutters to extend radially out past and alongside the drill shoe pdc cutters.

In another embodiment, a drilling float may be installed in the bit for well control.

While the invention has been described in conjunction with the disclosed embodiments, it will be understood that the invention is not intended to be limited to these embodiments. On the contrary, the invention is intended to cover alternatives, modifications and equivalents, which may be included within the spirit and scope of the invention as defined by the appended claims.

What is claimed is:

1. A borehole drilling tool, comprising:

a drill shoe having a cylindrical sidewall, a bore and a threaded upper end for connection to a string of casing;

a plurality of cutting elements positioned at a lower end of the drill shoe;

a retrievable tubular member that lands in the drill shoe, the tubular member having a threaded lower end that extends below the cutting elements when landed for connection to a drill bit, the tubular member having a cylindrical sidewall and an axially extending passage that has an upper end in communication with the bore of the drill shoe for receiving drilling fluid pumped down the string of casing; and a plurality of cutting element ports extending through the sidewall of the tubular member, the cutting element ports having inlets at the bore of the tubular member and outlets on the exterior of the tubular member, the outlets being located below the lower end of the drill shoe when the tubular member has landed in the drill shoe, the cutting element ports being directed laterally outward toward at least part of the cutting elements for discharging drilling fluid onto said at last part of the cutting elements.

2. The drilling tool of claim 1, further comprising nozzles located within the cutting element ports.

3. The drilling tool of claim 1, wherein a line extending from the inlet to the outlet of each of the cutting element ports is located in a plane substantially perpendicular to an axis of the tubular member.

4. The drilling tool of claim 1, wherein some of the cutting elements are located above the outlets of the cutting element ports when the tubular member is landed.

5. A borehole drilling tool, comprising:

a drill shoe having a cylindrical sidewall, a bore and a threaded upper end for connection to a string of casing;

a plurality of cutting elements positioned at a lower end of the drill shoe, the cutting elements protruding laterally outward past an exterior surface of the sidewall;

a retrievable tubular member that lands in the drill shoe, the tubular member having a threaded lower end that extends below the cutting elements when in a landed position, the tubular member having a cylindrical sidewall that fits closely in the bore of the drill shoe and an axially extending passage that has an upper end in communication with the bore of the drill shoe for receiving drilling fluid pumped down the string of casing;

a drill bit having a threaded upper end secured to the threaded lower end of the tubular member, the drill bit having a plurality of earth disintegrating elements that are spaced below the cutting elements when the tubular member is in the landed position;

a drilling fluid cavity extending into the drill bit from an upper end of the drill bit;

a plurality of drill bit fluid ports extending from the drilling fluid cavity to the vicinity of the earth disintegrating elements for discharging drilling fluid pumped down the casing; and a plurality of cutting element ports extending through the sidewall of the tubular member, the cutting element ports having inlets at the bore of the tubular member and outlets on an exterior of the tubular member, the outlets being located below the lower end of the drill shoe and above the drill bit when the tubular member is in the landed position, the cutting element ports being directed laterally outward toward at least part of the cutting elements for discharging drilling fluid onto the cutting elements.

6. The drilling tool of claim 5, further comprising nozzles located within the cutting element ports.

7. The drilling tool of claim 5, wherein a line extending concentrically from the inlet to the outlet of each of the cutting element ports is located in a plane substantially perpendicular to an axis of the tubular member.

8. The drilling tool of claim 7, wherein the plane is located below the lower end of the drill shoe when the tubular member is in the landed position.

9. A borehole drilling tool, comprising:

a drill shoe having a cylindrical sidewall, a bore and a threaded upper end for connection to a string of casing;

a plurality of cutting elements positioned at a lower end of the drill shoe, the cutting elements protruding laterally outward past an exterior surface of the sidewall, at least some of the cutting elements being below the lower end of the drill shoe;

a tubular member that lands in the drill shoe, the tubular member having a threaded lower end that extends below the cutting elements when in a landed position, the tubular member having a cylindrical sidewall that fits closely in the bore of the drill shoe and an axially extending passage that has an upper end in communication with the bore of the drill shoe for receiving drilling fluid pumped down the string of casing;

a drill bit having a threaded upper end secured to the threaded lower end of the tubular member, the drill bit having a lower end containing a plurality of earth disintegrating elements that are spaced below the cutting elements when the tubular member is in the landed position, the tubular member and the drill bit being retrievable upwardly through the drill shoe;

a drilling fluid cavity extending into the drill bit from an upper end of the drill bit;

a plurality of drill bit fluid ports extending from the drilling fluid cavity to the lower end of the drill bit for discharging drilling fluid pumped down the casing; and a plurality of cutting element ports extending through the sidewall of the tubular member, the cutting element ports having inlets at the bore of the tubular member and outlets located below the lower end of the drill shoe and in alignment with at least some of the cutting elements when the tubular member is in the landed position, the cutting element ports being directed laterally outward from an axis of the tubular member and containing a nozzle for discharging drilling fluid.

10. The drilling tool of claim 9, wherein a line extending concentrically from the inlet to the outlet of each of the cutting element ports is located in a plane substantially perpendicular to an axis of the tubular member.

11. The drilling tool of claim 9, wherein the plane is located below the lower end of the drill shoe when the tubular member is in the landed position.

* * * * *